United States Patent [19]

Hunt

[11] Patent Number: 5,044,535

[45] Date of Patent: Sep. 3, 1991

[54] EXPANDABLE GARMENT HANGER FOR PANTS OR SKIRT WITH RELEASING LEVER

[75] Inventor: William J. Hunt, Finchley, United Kingdom

[73] Assignee: Braitrim (U.K.) Limited, London, England

[21] Appl. No.: 473,977

[22] PCT Filed: Oct. 21, 1988

[86] PCT No.: PCT/GB88/00919

§ 371 Date: Apr. 17, 1990

§ 102(e) Date: Apr. 17, 1990

[87] PCT Pub. No.: WO89/03652

PCT Pub. Date: May 5, 1989

[30] Foreign Application Priority Data

Oct. 23, 1987 [GB] United Kingdom ..... 8724851

[51] Int. Cl.[5] ..... A47G 25/62; A47G 25/68; A47G 25/44; A47G 25/14

[52] U.S. Cl. ..... 223/95; 223/88; 223/89; 223/85; 223/96; D6/315

[58] Field of Search ..... 223/85, 88, 89, 94, 223/95, 92, 96; 211/113; 248/317; D6/315, 327

[56] References Cited

U.S. PATENT DOCUMENTS

| | | | |
|---|---|---|---|
| 666,235 | 1/1901 | Osgood | 223/95 |
| 1,922,858 | 8/1933 | Page | 223/85 |
| 2,332,203 | 10/1943 | Chidley | 223/95 |
| 2,477,873 | 8/1949 | Hopkins | 223/89 |
| 2,494,711 | 1/1950 | Kusher | 223/89 |
| 2,589,374 | 3/1952 | Hannon | 223/89 |
| 2,793,799 | 5/1957 | Frank et al. | 223/95 |
| 2,919,839 | 1/1960 | Burns | 223/95 |
| 3,070,269 | 12/1962 | Zuckerman | 223/88 |

FOREIGN PATENT DOCUMENTS

| | | | |
|---|---|---|---|
| 286192 | 7/1915 | Fed. Rep. of Germany | 223/94 |
| 1247978 | 11/1960 | France | 223/94 |
| 1309190 | 7/1961 | France . | |

*Primary Examiner*—Werner H. Schroeder
*Assistant Examiner*—Bibhu Mohanty
*Attorney, Agent, or Firm*—Ladas & Parry

[57] ABSTRACT

The garment hanger is disclosed having a body and a hook mounted on the body to suspend the hanger on a rail. A movable arm is conveniently slidably mounted in the body for free movement in at least one direction, preferably the outward direction. A locking device is mounted on the body to lock the movable arm relative to the body against movement in an inwardly direction preferably by the interengagement of teeth on the locking device with ratchet teeth along the top edge of the corresponding movable arm. The locking means is releasable by a lever mechanism operated remotely from the locking device to allow free movement of the arm in either an outward or inward direction. Conveniently, the releasable lever mechanism is mounted on a garment engagable portion at the outermost end of the movable arm. In one preferred embodiment of a garment hanger two arms are slidably simultaneously in the hanger body in mutually opposite directions, and the locking means is mounted for engagement with one of the movable arms.

15 Claims, 1 Drawing Sheet

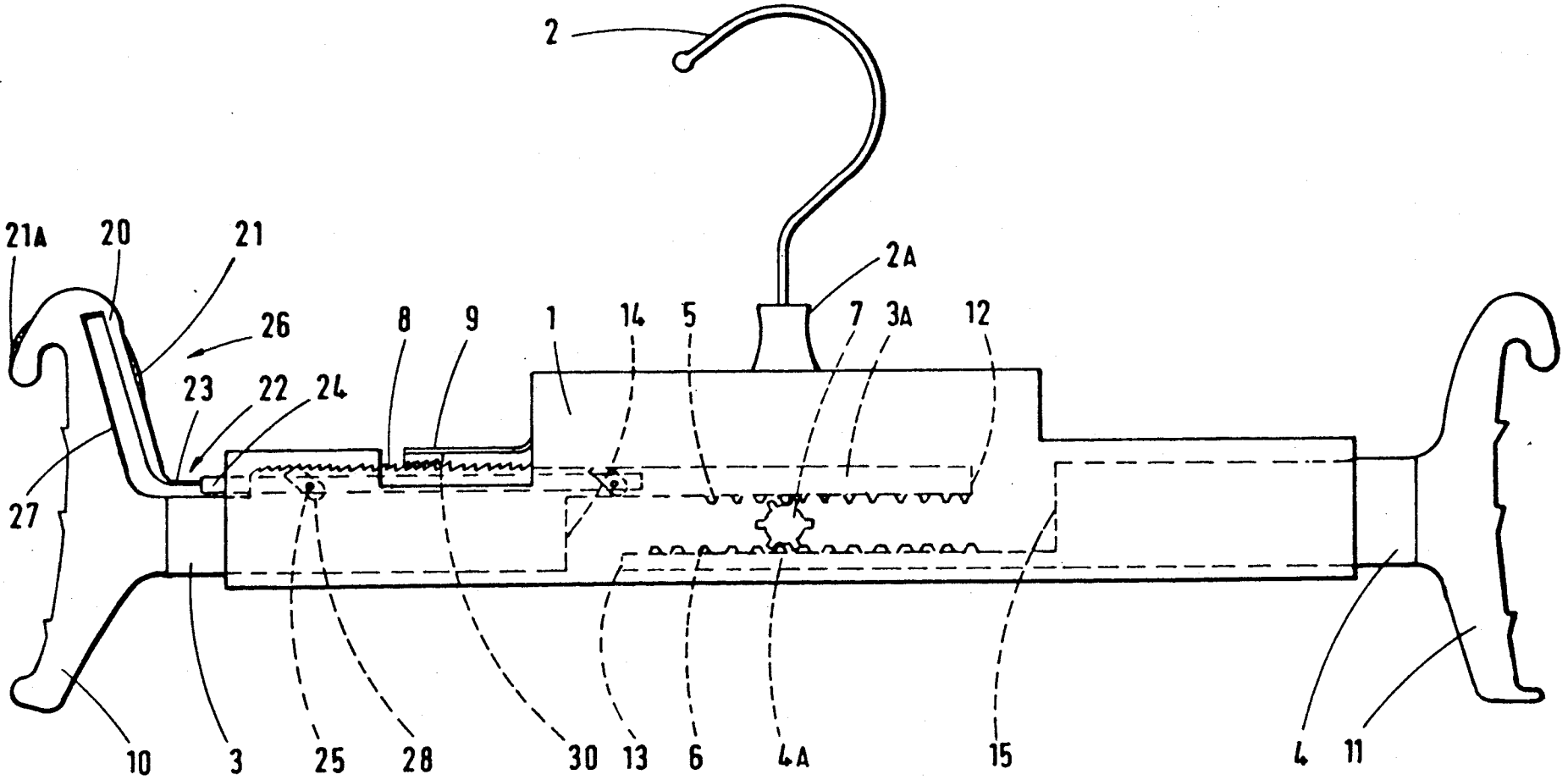
2
2A
12
3A
7
5
14
1
9
8
21
26
20
21A
24
22
23
27
11
4
15
4A
6
13
30
28
25
3
10

EXPANDABLE GARMENT HANGER FOR PANTS OR SKIRT WITH RELEASING LEVER

BACKGROUND OF THE INVENTION

1. Field of the Invention

The present invention relates to expandable garment hangers.

2. Background Art

Garment hangers in which the outer ends are intended to grip waistbands of garments such as trousers and skirts are well known. It is also known for the hanger to have a structure which is used to accommodate waistbands of different sizes. However, up till now, it has been difficult to construct a hanger in which the full range of sizes from 8 to 20 can be accommodated. Hangers having varying widths have been proposed in which two gripping ends are moved in dependence one upon the other from a centre portion and locked in position against the waistband of a garment to be supported so that the hanger is maintained at its selected position.

There has been at least one attempt to overcome these problems by providing a garment hanger with a central guide body from which extends two movable arms, one from each end. The body has a centrally located hook and a mechanism interconnecting the arms so that movement of one causes a movement of the other in an opposite direction. A locking device is pivotally mounted on the body and is in the form of a pivotal lever which on one side of the pivot engages with a series of serrations to lock the arms from movement in one direction, and on the other side of the pivot is a release lever. When pressure is applied to the release lever the portion thereof engaging the serrations disengages from the serrations to release the arms for movement in either direction.

Disadvantageously, the hanger when inserted into a garment such as a skirt sometimes lies with the bulk of the hanger inside the garment thus making it difficult to operate a locking device to release the movable arms inwardly and detach the garment from the hanger.

Therefore, it is desirable to provide a hanger in which the above mentioned disadvantages are substantially overcome.

SUMMARY OF THE INVENTION

According to the present invention there is provided a hanger having a body and a hook on the body for suspending the hanger, a movable arm slidably mounted on the body for free movement in at least one direction, locking means located on the body for locking the movable arm relative to the body against movement in a direction opposite to said at least one direction, and releasable means mounted independently of the locking means and comprising a lever mechanism for remotely operating the locking means to release the movable arm for free movement thereof in opposite directions.

In one preferred embodiment of the invention there is provided a hanger which will support garments with varying waist widths and maintain the portion which fits the garment at the desired spacing once the garment is mounted on the hanger.

Preferably, there is provided on the hanger a central guide body of a width at least no greater than the minimum width of the desired range of garments, two arms mounted on the central guide portion for slidable movement in opposite directions relative to each other, garment locking means on the central guide body to lock each of the arms at selected positions, preferably against inward movement of said arms. The locking means preferably comprises a series of notches or teeth on at least one arm which are arranged to engage with at least one stop on the central guide body so as to locate or lock each arm in a selectable series of positions. Such engagement can be obtained automatically where the guide body has a configuration such that on mounting a garment by the gripping means the weight of the garment tends to draw the arms outwardly to an appropriate point at which they then lock in relation to the central guide body preventing inward movement of the arms. Conveniently, a ratchet can be provided on the upper and lower sides of the arms engaging with the stop member on one or each end of the guide body. Alternatively, each of the arms can be provided with a form of ratchet which engages with a releasable catch conveniently located on the guide body, for example at one or each end of the guide body.

The at least one stop on the central guide body can be integrally formed with the guide body and extends therefrom in a direction parallel to the direction in which the ratchet extends, and has teeth on the free end thereof remote from that end integral with the guide body for engaging with the teeth of the ratchet on the movable arm. The interim engaging teeth of the either member and ratchet cooperate to restrict movement of the arms of the hanger in a preferably inwardly direction.

A release mechanism for disengaging the interlocking teeth is preferably mounted on the rear or innermost surface of a garment gripper means located at the extreme outer end of the at least one movable arm.

When the hanger is supported by the hook, the release means has a substantially vertical downwardly extending resilient portion integrally moulded with the top of a garment gripper means and a bar portion connected with the vertical portion and extending in a direction substantially parallel to the movable arm. The bar portion is preferably of a plastics material for engaging a cam follower plate on the stop lever which has teeth at its free end for interlocking with ratchet teeth on the movable arm. The cam plate is conveniently located adjacent to the teeth on the stop lever. The cam plate extends downwardly below the teeth so that when pressure is applied to the cam plate by vertical upward movement of the bar portion of the release mechanism the upper edge of the bar engages the cam plate of the stop lever and pushes the lever upwardly to disengage its teeth from the teeth of the ratchet on the movable arm. Accordingly, the extendible arms become freely movable.

The vertical upward movement of the bar portion of the release mechanism is achieved by one or more pins which extend outwardly of the bar portion into angled slots in the side face of the movable arm or arms with which the bar portions are associated. The angle of the slots relative to the direction of movement of the movable arm is preferably 45° and as the bar portion is moved in the outwardly direction the pins engage the slots and move the bar portion upwardly to engage the cam plate. Two pins are preferred in a longitudinally spaced relationship on the bar portion so that the bar portion remains parallel with the movable arm and ensures even movement of the bar portion against the cam plate irrespective of the relative location of the movable arm and central guide portion.

Preferably, the innermost ends of each of the arms are provided with a toothed or geared portion engaging with a centrally located gear wheel rotatably mounted on the central guide body so that movement of one arm inwardly or outwardly inherently moves the other arm in the opposite direction so that both arms move either inwardly or outwardly together. Again, to ensure locking of the arms at a series of positions, at least one of the arms is provided with a series of notches or stopping portions which engage with an appropriate locking means on the central guide body.

BRIEF DESCRIPTION OF DRAWING

One embodiment of the present invention will now be described by way of example with reference to the accompanying drawing which shows a partial side elevational view of an expandable garment hanger according to the present invention.

DESCRIPTION OF PREFERRED EMBODIMENT

Referring specifically to FIG. 1, an expandable garment hanger is provided comprising a central hollow guide body 1 having a centrally located hook 2 for suspending the hanger, which hook is rotatably mounted in a bush 2A of the guide portion 1. Two arms 3, 4 are slidably mounted within the hollow guide body 1 and the innermost end of each arm has a part 3A, 4A of reduced width on which is located a gear toothed portion 5, 6 respectively, extending inwardly from each of the arms. A geared wheel 7 rotatably mounted centrally of the central guide body is engaged with each of the toothed portions 5, 6. Consequently, movement in one direction of one of the arms 3, 4 by reason of interaction between the respective gear toothed portion and wheel 7 moves the other arm in the opposite direction.

One of the arms 3 is provided with a ratchet portion 8 comprising a plurality of teeth being located towards the outermost end of the arm and on the upper surface thereof as shown in the drawing. The corresponding end of the guide body 1 has a stop lever 9 integrally formed therewith for locking engagement with ratchet teeth 8. The end of the lever 9 remote from that end integrally moulded with the central guide body is correspondingly toothed and free to move upwardly and downwardly to engage or disengage with the teeth on the ratchet 8. Each outer end of the arms 3, 4 is provided with a garment gripping device 10 and 11 which are angled relative to the longitudinal axis of the arms 3, 4 to prevent a garment slipping off the hanger in use.

Each garment gripping device 10, 11 extends above and below the arms 3, 4 respectively. One of the garment gripper devices has integrally formed on an upper portion thereof a substantially vertically extending actuating arm 20 having a serrated grip portion 21 located thereon. A second serrated grip portion 21A is provided on the outer curved surface of the one gripper device. A cam operating bar 22 is attached to the end of the actuating arm 20 opposite to that end attached to the garment gripper device 10 and extends transversely to the actuating arm 20 in a direction substantially parallel to the arm 3. The cam operating bar 22 is of a two part construction each comprising a thin strip of plastics material attached together with the plane of the major surface of each strip being at right angles to each other. A first part of the cam bar 22 is a relatively short length or strip of plastics material 23 which is directly attached to the end of the actuating arm 20 remote from its integral connection with the garment gripping bar 10. The second part 24 of the cam bar 22 has its major plane in a vertical direction and is much longer than the part 23 so that it extends beneath the stop lever 9 even though the arms 3 and 4 are fully extended. The arm 3 is provided with a ridge (not shown) along the length of one side thereof for supporting the cam bar 22 adjacent to the arm 3 and within the central guide portion 1.

Two pins 25 extend perpendicularly and outwardly from the major surface of the bar portion facing the movable arm 3. The arm 3 in turn has a pair of slots 28 provided in the surface thereof adjacent to the bar portion for receiving the pins 25 thereon that as the bar portion 24 is moved in a direction parallel to the direction of the movement of the movable arm 3 the pins 26 engage the walls defining the slots which are preferably at an angle of 45° relative to the longitudinal axis of the movable arm. As the bar portion 24 moves further the pins 25 extend further along the slots 28 and the bar portion moves upwardly to engage a cam plate 30 which is mounted adjacent the teeth on the free end of the stop lever 9 and extends down below the teeth on that one side thereof.

In describing the operation of the hanger it is assumed the arms 3, 4 are in their most inwardly position in which free ends 12, 13 of overlapping portions 3A, 4A abut end walls 15, 14 respectively of the opposite arm.

The expandable garment hanger is then placed inside the waistband of a garment such as a skirt or a pair of trousers with, for example, garment gripping device 10 against the waistband. The arm 4 is pulled outwardly of the central guide body 1 until the garment gripping device 11 engages the opposite side of the waistband. As the arm 4 moves outwardly the arm 3 automatically moves outwardly until the waistband of the garment is at full width. The teeth on stop lever 9 engages the ratchet teeth 8 and prevents inward movement of the arms 3, 4 thus ensuring the garment is securely supported at its waistband without stretching or distorting the garment.

The garment is removable from the hanger by applying by the thumb and forefinger for example on pressure grips to move the actuating arm 20 in the direction of arrow 26 causing the actuating arm and bar portion 22 to move towards the rear surface 27 of the garment gripping member 10. As pressure is applied in the direction of the arrow 26 the pins on the bar portion 22 engage the inclined walls of the slots on the movable arm 3 to move the bar portion 22 in a transverse upwardly direction relative to the movable arm 3 and thereby to engage the edge of cam plate 30 located adjacent to the teeth on the free end of the lever 9 forcing the teeth of the lever to disengage with the ratchet teeth 8 and allowing the arms 3 and 4 to be moved freely in either direction. Once the arms 3 and 4 are moved towards the inner most position the garment can be removed from the hanger.

In an alternative embodiment more than two pins 25 can be provided for example 3 or 4 such pins, with each having a corresponding slot 28.

Although the bar 24 is described as moving towards the left hand side of the guide body 1 to lift the stop or cam lever 9, the bar 24 can, as indicated in the scissor operation embodiment disclosed above, move to the right hand side of the guide body 1, in which case the slots 28 will lie at an angle of say 45° to the right hand side of the guide body rather than 45° to the left hand side as shown in the accompanying drawing.

Whilst the angle of the slots is described as being 45° the angle can be any angle within the range say 5° to 80°.

Whilst the stop lever 9 is integrally formed at one end thereof with the central guide body, the lever can be separately mounted on the guide body.

Whilst the present invention has been described with referrence to a locking device and/or release device on one end of the hanger, such devices can be provided at both ends of the garment hanger.

In an alternative embodiment a lever can be provided on which the actuating lever 20 is pivotally mounted centrally thereof to have a scissor like movement so that applying pressure on the actuating lever in the direction of the arrow 26 causes the bar portion 22 to move towards the centre of the hanger to achieve the separation thereof with the movable arm to disengage the locking device.

In one alternative construction of an expandable garment hanger according to the present invention the actuating arm 20 and cam bar 22 are constructed in a substantially identical manner to that just described but are located with the actuating arm being mounted on an extended portion of the bush 2A which supports the central hook 2. An aperture is provided in the central guide body to allow interconnection with the cam bar 22 to move the cam plate attached to the stop lever 9.

The bar portion 23 is resilient enough to bow when sufficient pressure is applied to the actuating arm 20 and the junction of arm 20 and bar portion 23 engages the rear surface of the garment gripping device 10. The bowing action can assist in raising the bar portion 22 towards the cam plate to disengage the interlocking teeth by applying pressure to the opposed end of the bar 22 for example in the region of the central hook 2.

In a further alternative expandable garment hanger according to the present invention the movement of the arms 3, 4 is obtained by replacing the gear toothed portion and wheel by a lever pivotally mounted between opposite ends thereof, and connected at the opposite ends to a respective one of the inner ends of the arms 3, 4.

I claim:

1. A garment hanger having a body and a hook mounted on the body for suspending the hanger on a rail, a movable arm slidably mounted in the body for free movement in at least one direction, locking means mounted on the body for locking the movable arm relative to the body against movement in a direction opposite to the said at least one direction, and releasable means for releasing the locking means to allow free movement of the arm in the said opposite direction, wherein the releasable means are mounted independently of the locking means and comprise a lever mechanism for remotely operating the locking means to release the movable arm for free movement thereof in the said opposite direction.

2. A garment hanger as claimed in claim 1, wherein the releasable means is mounted on the movable arm.

3. A garment hanger as claimed in claim 2, wherein the releasable means includes a substantially vertically downwardly extending resilient portion connected to a bar portion arranged to extend in a direction which is substantially parallel to the direction of movement of the movable arm in the body.

4. A garment hanger as claimed in claim 3, including a garment engaging portion located at the extreme outer end of the movable arm for supporting a garment thereon, the releasable means being mounted on the innermost surface of the garment engaging portion.

5. A garment hanger as claimed in claim 1, wherein the locking means comprises an arm pivotally mounted on the said body and having a series of teeth on a free end thereof, which teeth are arranged to engage with teeth on the movable arm to lock the arm in a selected series of positions.

6. A garment hanger as claimed in claim 5, wherein the locking means comprises a ratchet on the upper side of the movable arm engagable by a stop member mounted on the end of the body from which the movable arm extends.

7. A garment hanger as claimed in claim 6, wherein the ratchet is engagable with a releasable catch located in the body.

8. A garment hanger as claimed in claim 3, wherein the body has a width at least no greater than the minimum width of the desired range of garments and two arms are mounted in the body for simultaneous slidable movement in opposite directions relative to each other.

9. A garment hanger as claimed in claim 8, including a garment engagable portion being mounted at the free outermost end of each arm.

10. A garment hanger as claimed in claim 9, wherein the locking means comprises at least one stop lever on the body integrally formed therewith and extending therefrom in a direction parallel to the direction in which the movable arm extends, the stop lever having teeth on the free end thereof remote from that end integral with the body for engaging with the teeth of a ratchet extending along the movable arm.

11. A garment hanger as claimed in claim 10, including a cam follower on the stop lever, the follower extending downwardly below the teeth thereof so that upon pressure being applied to the cam follower by vertical upward movement of the bar portion of the releasable means upon operation of the vertically downwardly extending resilient portion thereof, an upper edge of the bar engages the cam plate of the stop lever and moves the lever upwardly to disengage the teeth thereof from the teeth of the ratchet on the movable arm.

12. A garment hanger as claimed in claim 11, including a plurality of guide pins extending outwardly from the bar portion into angled slots defined in the side face of the movable arm for directing movement of the bar portion relative to the movable arm in an elongate and upward manner.

13. A garment hanger as claimed in claim 12, wherein the angle of the angled slots in the movable arm relative to the elongate direction of movement of the movable arm is 45 degrees.

14. A garment hanger as claimed in claim 8, wherein each arm includes a toothed portion engagable with a common centrally located gear wheel rotatably mounted in the body so that movement of one arm in one direction moves the other arm in the opposite direction so that both arms move in opposite directions together.

15. A garment hanger having a body and a hook mounted on the body for suspending the hanger on a rail, a pair of pivotal arms slidably mounted in the body for free movement in at least one direction, locking means located on the body and being engagable with at least one of the said movable arms for locking the movable arms relative to the body against movement in a direction opposite to the said at least one direction, and releasable means for releasing the locking means to allow free movement of the arm in the said opposite direction, wherein the releasable means are mounted independently of the locking means and comprise a lever mechanism for remotely operating the locking means to release the movable arms for free movement thereof in the said opposite direction, and wherein each arm includes a toothed portion engagable with a common centrally located gear wheel rotatably mounted in the body so that movement of one arm in one direction moves the other arm in the opposite direction so that both arms move in opposite directions together.

* * * * *